US007854530B2

(12) United States Patent
Wu et al.

(10) Patent No.: US 7,854,530 B2
(45) Date of Patent: Dec. 21, 2010

(54) LAMP STRUCTURE WITH DAMPER

(75) Inventors: Cheng Hsiu Wu, Taipei (TW); Chih Chun Li, Taipei (TW)

(73) Assignee: Feton Limited, Taipei (TW)

( * ) Notice: Subject to any disclaimer, the term of this patent is extended or adjusted under 35 U.S.C. 154(b) by 255 days.

(21) Appl. No.: 12/251,902

(22) Filed: Oct. 15, 2008

(65) Prior Publication Data

US 2010/0059351 A1 Mar. 11, 2010

(30) Foreign Application Priority Data

Sep. 9, 2008 (TW) ..... 97216279 U

(51) Int. Cl.
*F21V 33/00* (2006.01)

(52) U.S. Cl. ..... 362/206; 362/155; 362/133

(58) Field of Classification Search ..... 362/206, 362/155, 133, 94, 132, 200, 205, 295, 362, 362/394, 125, 411
See application file for complete search history.

(56) References Cited

U.S. PATENT DOCUMENTS 1,295,497 A * 2/1919 Henderson et al. ..... 362/206
2,156,462 A * 5/1939 Schulte ..... 362/191
2,172,523 A * 9/1939 Soreng ..... 362/94
5,032,957 A * 7/1991 Canfield ..... 362/133
6,033,084 A * 3/2000 Burke ..... 362/155
6,824,290 B2 * 11/2004 Noda et al. ..... 362/155
6,953,258 B1 * 10/2005 Goins ..... 362/155
2006/0087836 A1 * 4/2006 Morris et al. ..... 362/155

* cited by examiner

*Primary Examiner*—Bao Q Truong
(74) *Attorney, Agent, or Firm*—C. G. Mersereau; Nikolai & Mersereau, P.A.

(57) ABSTRACT

The present invention relates to a lamp structure with a damper. The lamp structure is primarily for installation inside a cabinet. The electrical loop of the lamp structure is electrically connected by opening the door, and the illumination member of the lamp structure generates light to illuminate the interior of the cabinet. Conversely, when the door is closed, the damper is driven to touch the power switch to make the electrical loop of the lamp structure in the electrically disconnected state, and the illumination member no longer generates light.

16 Claims, 8 Drawing Sheets

LAMP STRUCTURE WITH DAMPER

FIELD OF THE INVENTION

The present invention relates to a lamp structure with damper. The damper is designed to press touch a power switch of the lamp and turn the light source on or off. The damping function can further protect the entire structure.

BACKGROUND OF THE INVENTION

Cabinets on the market in general meet the basic aesthetic and pragmatic demands, but not necessarily the general demand for convenience. Illumination is apparently one problem. Cabinets are common furniture in homes and offices, but most cabinets do not come with illumination equipment, or if they do, they tend to be much more expensive or the mechanical and electrical design of the illumination equipment is so inadequate that it is easily damaged and is inconvenient to use.

From the observation of the inventor, most products on the market do not meet performance standards or still have much room for improvement. Thus, in consideration of the drawbacks of products on the market, the inventor has given every effort to research and develop a new product to improve current products.

SUMMARY OF THE INVENTION

The invention relates to a lamp structure with a damper and provides a lamp structure providing illumination when the user opens the cabinet door. The damper design further protects the user and the whole structure.

The invention relates to a lamp structure with a damper, comprising a housing, an illumination, a damper, a power supply member, a electrical loop member and a power switch unit. The housing includes a casing structure with a hollow member and contains an opening member on one end surface of the housing that communicates the hollow member with the exterior environment. An illumination member includes an illumination component and is arranged on the housing. A damper comprises a post member, a first elastic component and a shaft. The post member is a hollow post with a casing structure, and the cross-sectional area of the post member matches the cross-sectional area of the hollow member. The two ends of the post member are a first end member and a second end member respectively, the first end member is one end where the post member passes through the opening member and protrudes from the housing, and the second end member is the other end of the post member moving inside the hollow member. The first elastic component is disposed inside the post member and one end thereof is against the bottom end of the first end member of the post member. The other end of the first elastic component connects to one end of the shaft, and the other end of the shaft passes through the casing of the second end member of the post member and is in contact with the housing. A power supply member is a power source. An electrical loop member is electrically connected to the illumination member and the power supply member. A power switch unit disposed in the electrical loop member to switch the status of the electrical loop member.

The damper is movable in the hollow member. A first position is defined when the damper is protruding from the housing and the casing of the damper do not touch the power switch unit as well as the electrical loop member is in an electrically connected state. A second position is further defined when the damper returns in the housing and the casing of the damper touches the power switch unit to make the electrical loop member in an electrically disconnecting state.

The objects, features and method of the invention as well as implementation of the invention are described in detail below with embodiments in reference to the accompanying drawings.

DETAILED DESCRIPTION OF THE INVENTION

The invention relates to a lamp structure with a damper. An embodiment of the invention is described in detail below.

Figure 1:
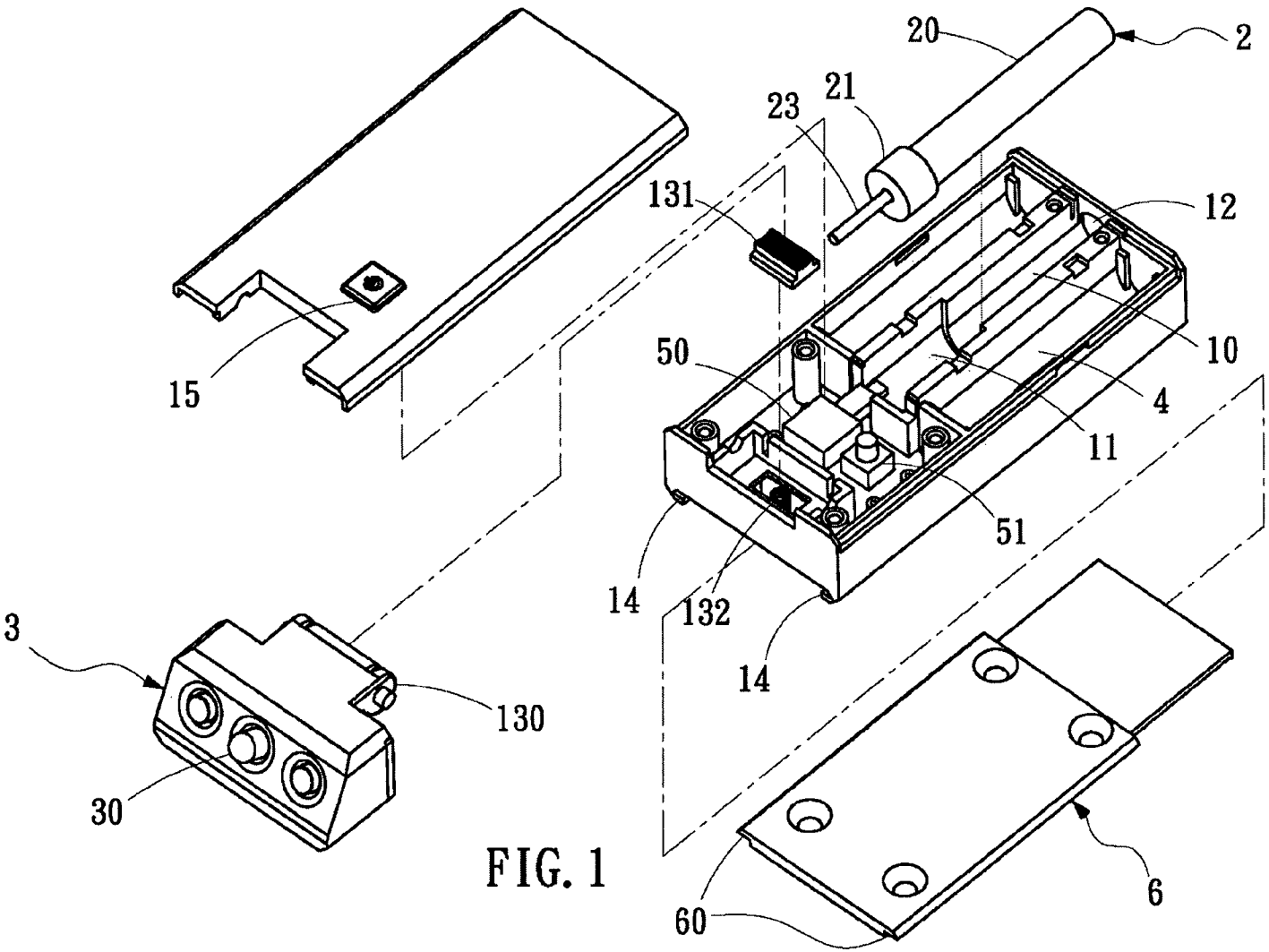
FIG. 1 is an exploded view of a lamp structure with damper according to the invention.
Figure 2:
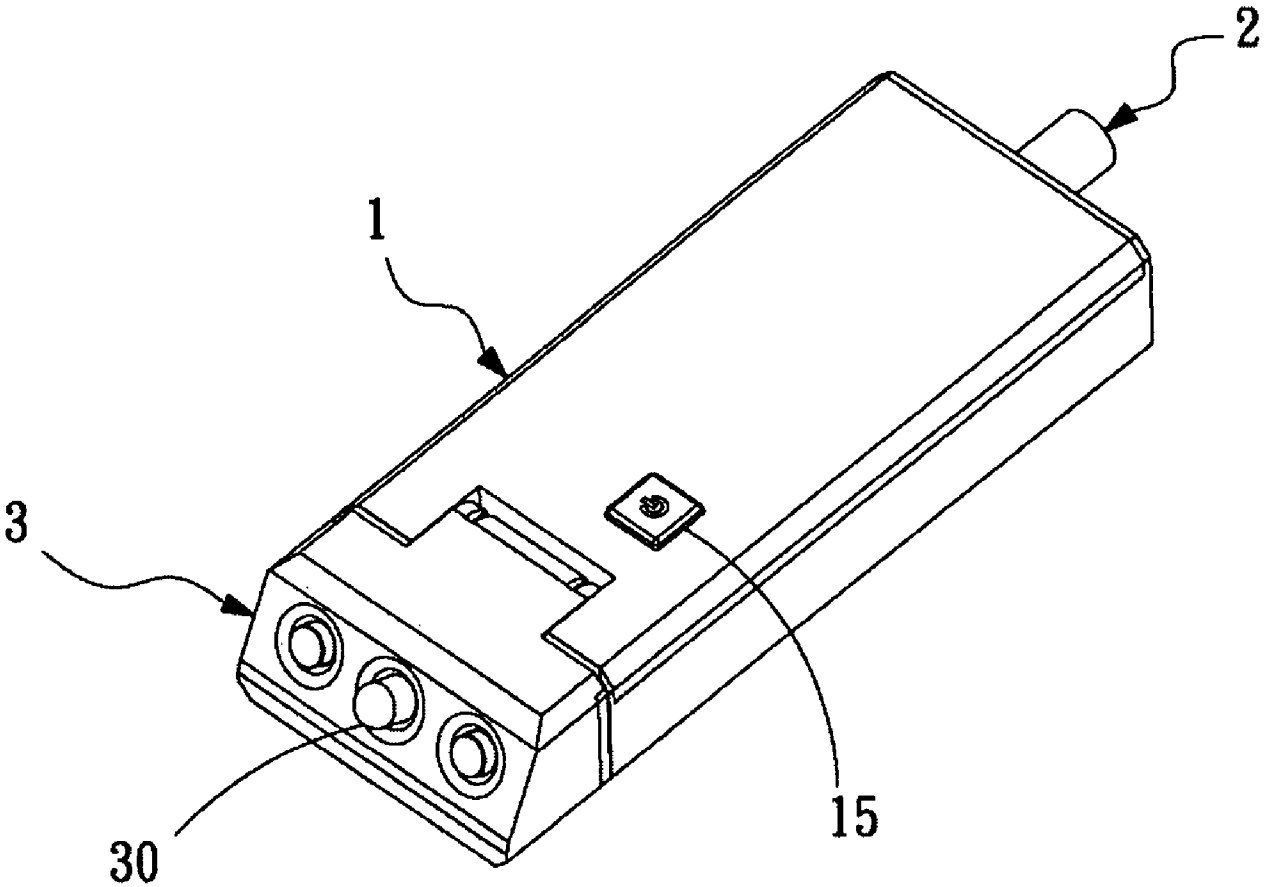
FIG. 2 is an assembly view of the lamp structure with damper according to the invention.
Figure 3:
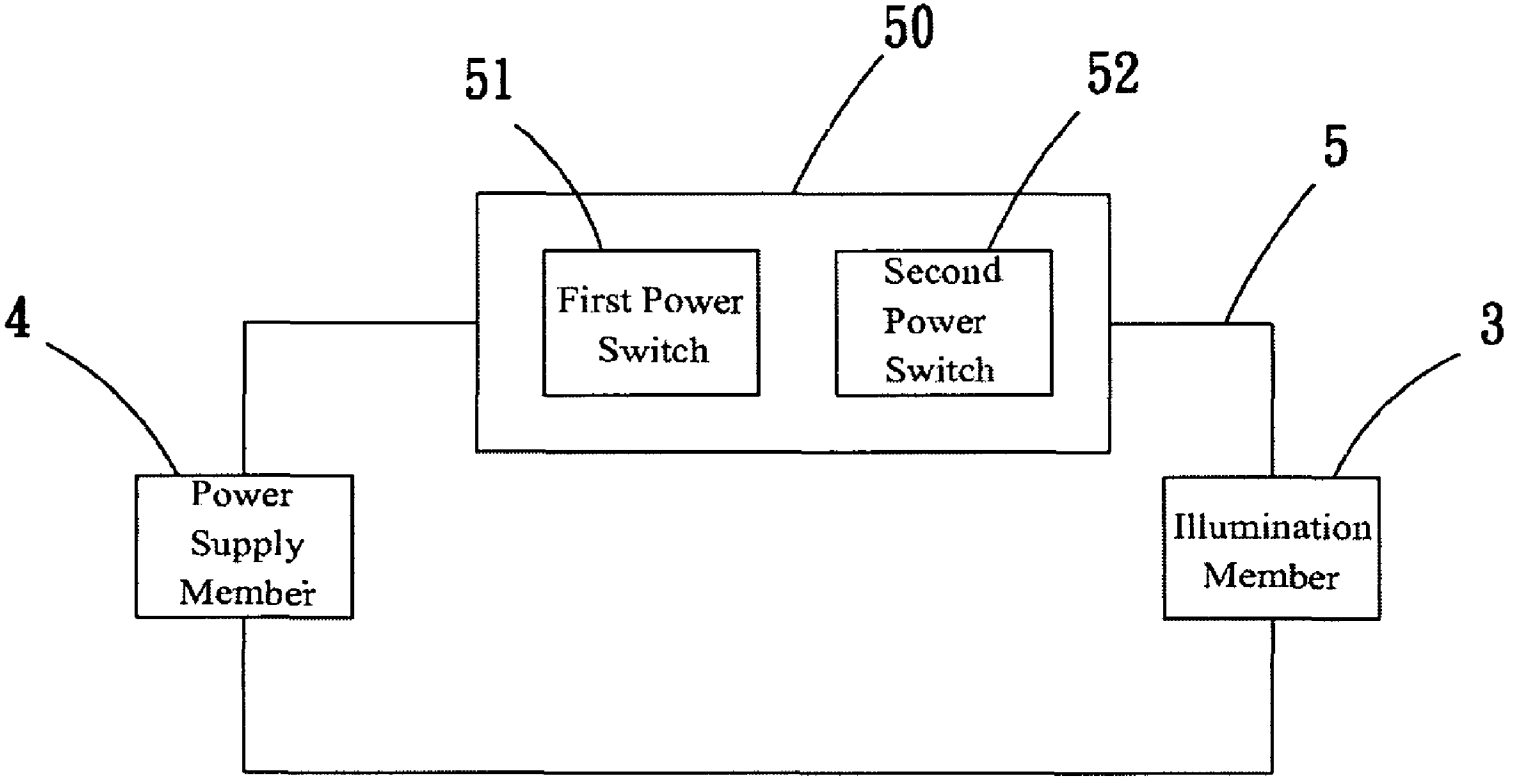
FIG. 3 is a diagram illustrating the electrical connection between components of the lamp structure with damper according to the invention.
Figure 4:
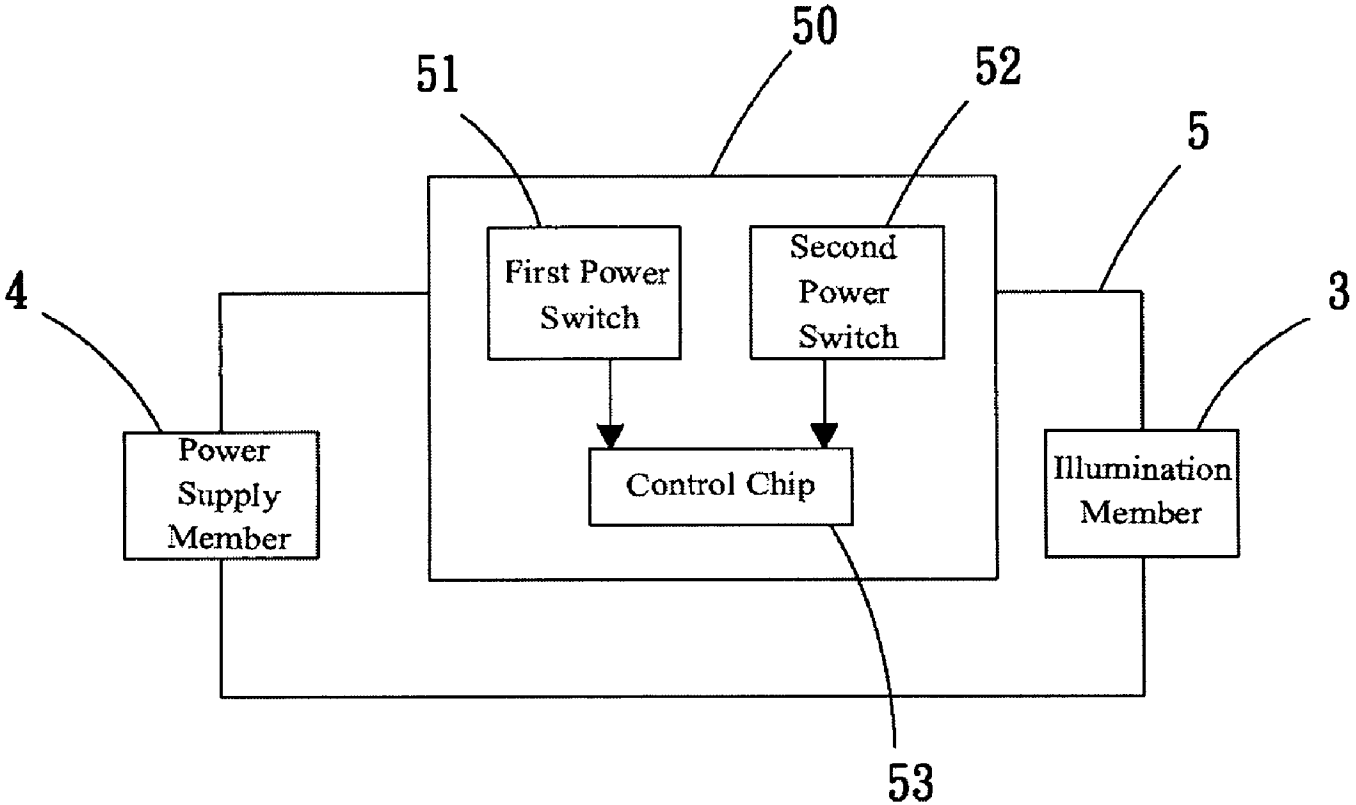
FIG. 4 is another diagram illustrating the electrical connection between components of the lamp structure with damper according to the invention.
Figure 5:
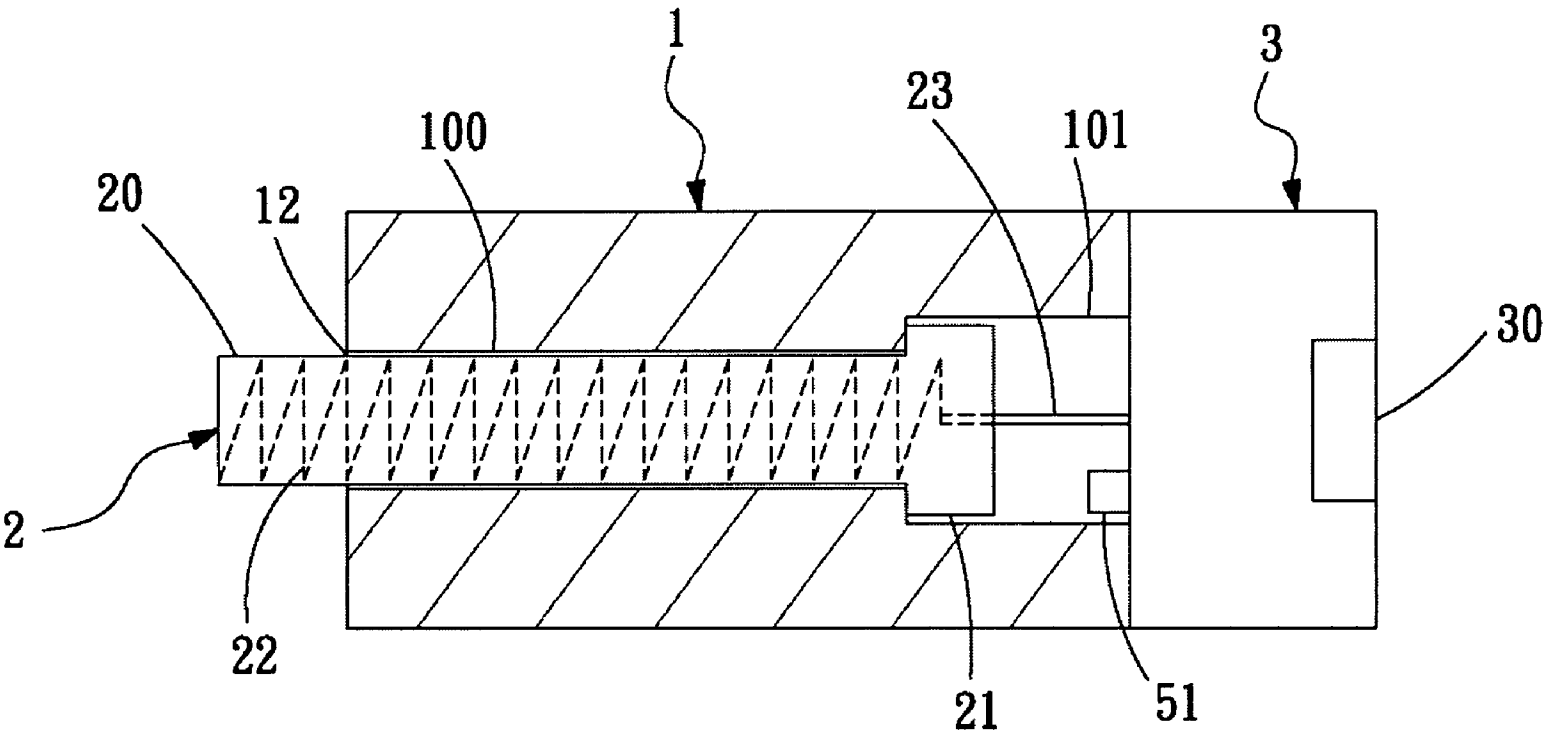
FIG. 5 is a diagram depicting the first position state of the lamp structure with damper according to the invention.
Figure 6:
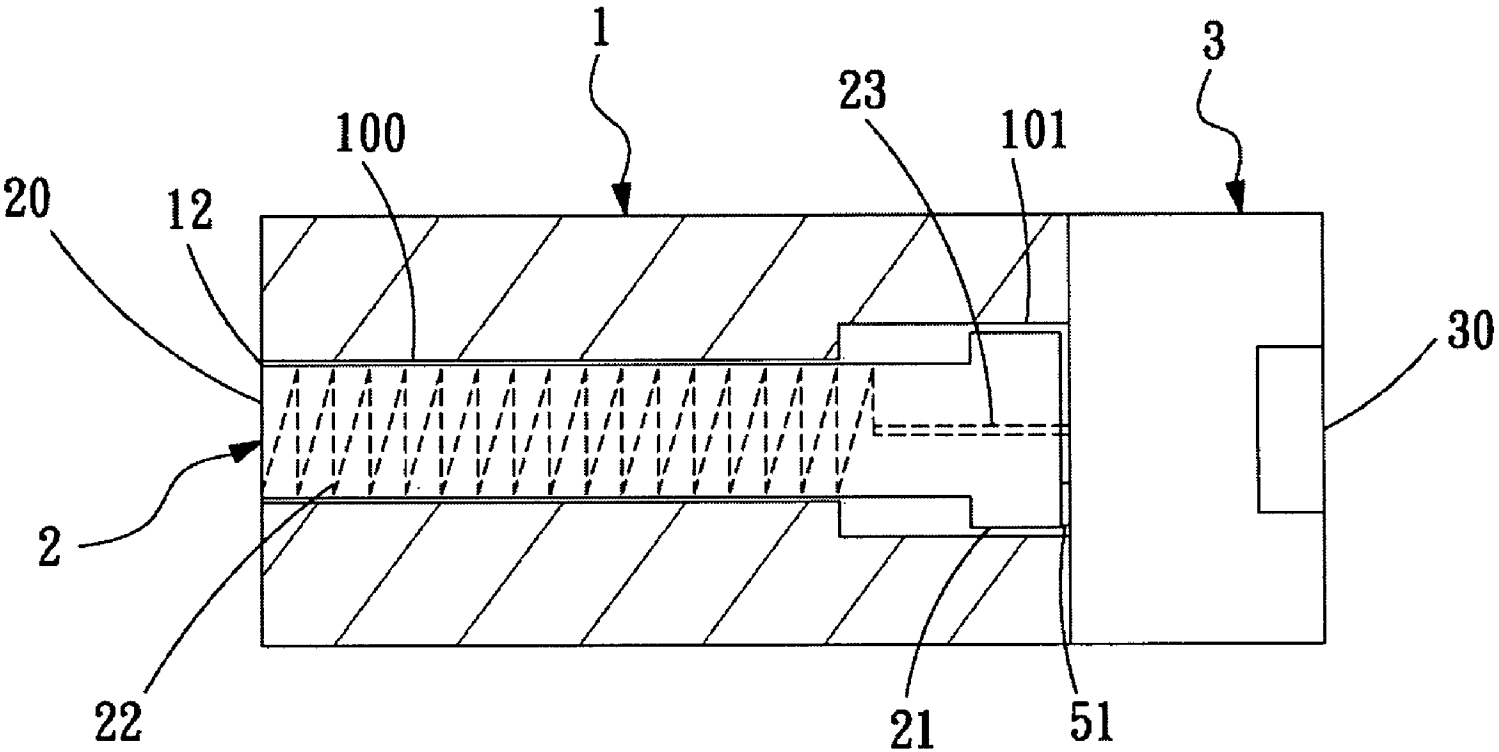
FIG. 6 is a diagram depicting the second position state of the lamp structure with damper according to the invention.

Referring to FIGS. 1~6, FIG. 1 is an exploded view of a lamp structure with damper according to the invention; FIG. 2 is an assembly view of the lamp structure with damper according to the invention; FIG. 3 is a diagram illustrating the electric connection between components of the lamp structure with damper according to the invention; FIG. 4 is another diagram illustrating the electric connection between components of the lamp structure with damper according to the invention; FIG. 5 is a diagram depicting the first position state of the lamp structure with damper according to the invention; and FIG. 6 is a diagram depicting the second position state of the lamp structure with damper according to the invention.

Referring to FIG. 1, the lamp structure with a damper of the invention includes a housing (1), a damper (2), an illumination member (3), a power supply member (4), an electrical loop member (5), a power switch unit (50) and a fixing plate (6). The housing (1) comprises a casing structure with a hollow member (10) and contains an opening member (12) on one end surface of the housing (1) that communicates the hollow member (10) with the exterior environment.

Again referring to FIG. 1, in the lamp structure with damper as mentioned above, the hollow member (10) of the housing (1) contains the damper (2) including a post member (20), a first elastic component (22) and a shaft (23). The post member (20) is a hollow casing structure, and the cross-sectional area of the post member (20) matches the cross-sectional area of the hollow member (10). The two ends of the post member (20) are a first end member and a second end member respectively. The first end member is one end where the post member (20) passes through the opening member (21) and protrudes from the housing (1), and the second end member is the other end where the post member (20) moves inside the hollow member (10). The first elastic component (22) is disposed inside the post member (20), one end thereof being connects to one end of the shaft (23) and the other end thereof is against an inside surface of the first end member of the post member (20) such that the shaft (23) is limited between an original position and a compression position by the first elastic component (22). In addition, one end of the shaft (23) is limited to inside of the post member (20) and the other end thereof passes through the casing of the second end member of the post member (20) and presses against the housing (1).

Again referring to FIG. 1, the end of the above-mentioned first elastic component (22) which is against the post member (20) can be firmly connected to the inside of the post member (20), mainly for the first elastic component (22) to provide an elastic force for the post member (20) and the shaft (23) such that after the post member (20) and the shaft (23) are exerted an external force to move relatively to the above-mentioned compression position of the shaft (23) and if the external force on the post member (20) and the shaft (23) is released, the first elastic component (22) will provide an elastic force for the post member (20) and the shaft (23) to move relatively again to the above-mentioned original position of the shaft (23). In addition, the objective of the end of the above-mentioned shaft (23) passing through the post member (20) and being against the housing (1) is to provide a reacting force to balance the above-mentioned external force which makes the post member (20) and the shaft (23) move relatively. Thus, the outer end of the shaft (23) can be against the housing (1) or be firmly disposed on the housing (1).

A fluid with a damping characteristic is stored in the post member (20) of the damper (2), and the fluid can be in a liquid state or in a gaseous state. Thus, when the post member (20) of the damper (2) moves relatively to the first elastic component (22), a dynamic system with elastic and damping characteristics is formed and achieves the effect of decreasing impact.

Again referring to FIG. 1, the structure of the above-mentioned housing (1) and the damper (2) can be carried out more ideally; the hollow member (10) further comprising a first hollow member (100) and a second hollow member (101), the opening member (12) being formed at a front end of the first hollow member (100) and a rear end thereof connecting the second hollow member (101); a cross-sectional area of the second hollow member (101) being greater than a cross-sectional area of the first hollow member (100), the second end member of the post member (20) further comprising a head member (21), a cross-sectional area of the head member (21) being greater than the cross-sectional area of the post member (20) and the first hollow member (100), and the post member (20) and the head member (21) being disposed respectively in the first hollow member (100) and the second hollow member (101).

Referring to FIGS. 1~2 in the above-mentioned lamp structure with damper, the illumination member (3) is disposed on the housing (1) and comprises one or a plurality of illumination components (30) for illumination, the illumination component (30) being a LED or any other light source and being driven by appropriate electricity.

Again referring to FIG. 3, in the above-mentioned lamp structure with damper, the power supply member (4) specifically can be a battery holder using general batteries, disposed inside the housing (1) as the power source or an external power source such that the power supply member (4) is an external battery pack or a transformer electrically connected to the city power system. The electrical connection that guides the power supplied by the power supply member (4) to the electrical loop member (5) can supply the power needed by the illumination member (3).

Again referring to FIG. 3, in the above-mentioned lamp structure with damper, the electrical loop member (5) is mainly an electrical loop electrically connecting the illumination member (3) and the power supply member (4); the electrical loop member (5) further comprises a power switch unit (50) for switching the electrical state of the electrical loop member (5) to be in one of electrically connected state and the electrically disconnected state.

Referring to FIGS. 5~6, in the above-mentioned lamp structure with damper, the damper (2) can move inside the housing (1). A first position is defined when the damper (2) is not subjected to an external force; meanwhile the damper (2) protrudes out of the opening member (12) by the recoil force of the first elastic component (22). Because the cross-sectional area of the head member (21) is greater than the cross-sectional area of the first hollow member (100), one cross-sectional end of the head member (21) is wedged in one cross-sectional end of the first hollow member (100); meanwhile the casing of the head member (21) does not touch the power switch unit (50) such that the electrical loop member (5) is in an electrically connected state. Then, a second position is defined when the damper (2) is touched by an object and subjected to an external force; meanwhile the damper (2) is wedged in the housing (1), and the casing of the head member (21) touches the power switch un it (50) such that the electrical loop member (5) is in an electrically disconnected state. When the external force vanishes, the damper (2) returns to the first position by the recoil force of the first elastic component (22).

Referring to FIG. 3, the above-mentioned power switch unit (50) of the electrical loop member (5) further comprises a first power switch (51) and a second power switch (52). The second power switch (52) can selectively control the electrical loop member (5) to be in one of the electrically connected state and the electrically disconnected state. When the damper (2) is at the first position and not subjected to an external force, the casing of the head member (21) does not touch the first power switch (51) such that the power switch unit (50) selects the electrical loop member (5) to be in the electrically connected state; however, by switching the second power switch (52), the power switch unit (50) can select the electrical loop member (5) to be in the electrically disconnected state. When the damper (2) is at the second position and subjected to an external force, the casing of the head member (21) touches the first power switch (51) such that the power switch unit (50) selects the electrical loop member (5) to be in the electrically disconnected state. Thus, when the head member (21) of the damper (2) releases the first power switch (51) of the power switch unit (50), the power switch unit (50) selects the electrical loop member (5) to be in the electrically connected state. Through the control of the second power switch (52), the power switch unit (50) can be further controlled to select the electrical loop member (5) to be in the electrically connected state or the electrically disconnected state.

The above-mentioned second power switch (52) can be a key switch and can be in ON or OFF state by the touching of an operator. In addition, only when the first power switch (51) and the second power switch (52) are both in ON state could the power switch unit (50) select the electrical loop member (5) to be in the electrically connected state. When either of the first power switch (51) and the second power switch (52) is in OFF state, the power switch unit (50) selects the electrical loop member (5) to be in electrically disconnected state.

The above-mentioned second power switch (52) can further be controlled by a button (15) on the housing (1). The button (15) controls the operation of the key switch.

Again referring to FIG. 4, the above-mentioned power switch unit (50) further comprises a control chip (53), the control chip (53) being a logic controller and being able to switch the state of the power switch unit (50) to select the electrical loop member (5) to be in the electrically connected or disconnected state in correspondence to the state of the first power switch (51) and the second power switch (52). Moreover, when the first power switch (51) is touched by the head member (21) of the damper (2), the control chip (53) responds by setting the second power switch (52) in ON state.

Thus, when the head member (21) of the damper (2) releases the first power switch (51) of the power switch unit (50) and switches the second power switch (52) to OFF state, the power switch unit (50) selects the electrical loop member (5) to be in the electrically disconnected state; meanwhile, if the head member (21) of the damper (2) again touches the first power switch (51) of the power switch unit (50) and then releases the first power switch (51) of the power switch unit (50), the second power switch (52) returns to ON state such that the power switch unit (50) selects the electrical loop member (5) to be in the electrically connected state.

Again referring to FIG. 1, in the above-mentioned lamp structure with damper, the housing (1) and the illumination member (3) are independent individuals and can be matched to be assembled and rotate relatively for the need of illumination. The illumination member (3) is electrically connected to the power supply member (4) by the electrical loop member (5). The invention is carried out by the embodiment as below. The housing (1) and the illumination member (3) further comprises a rotation unit comprising a rotation axle (130), a fixed axle (131) and a second elastic component (132). The rotation axle (130) is disposed in the illumination member (3). The fixed axle (131) is connected to one end of the second elastic component (132). The other end of the second elastic component (132) is disposed on the housing (1). The rotation axle (130) and the fixed axle (131) are both of a gear wheel structure and matches with each other for the illumination member (3) to rotate relative to the housing (1) and be adjusted to an angle needed. Besides, the second elastic component (132) provides the elastic and recoil force for keeping the angle of the illumination member (3) fixed.

Figure 7:
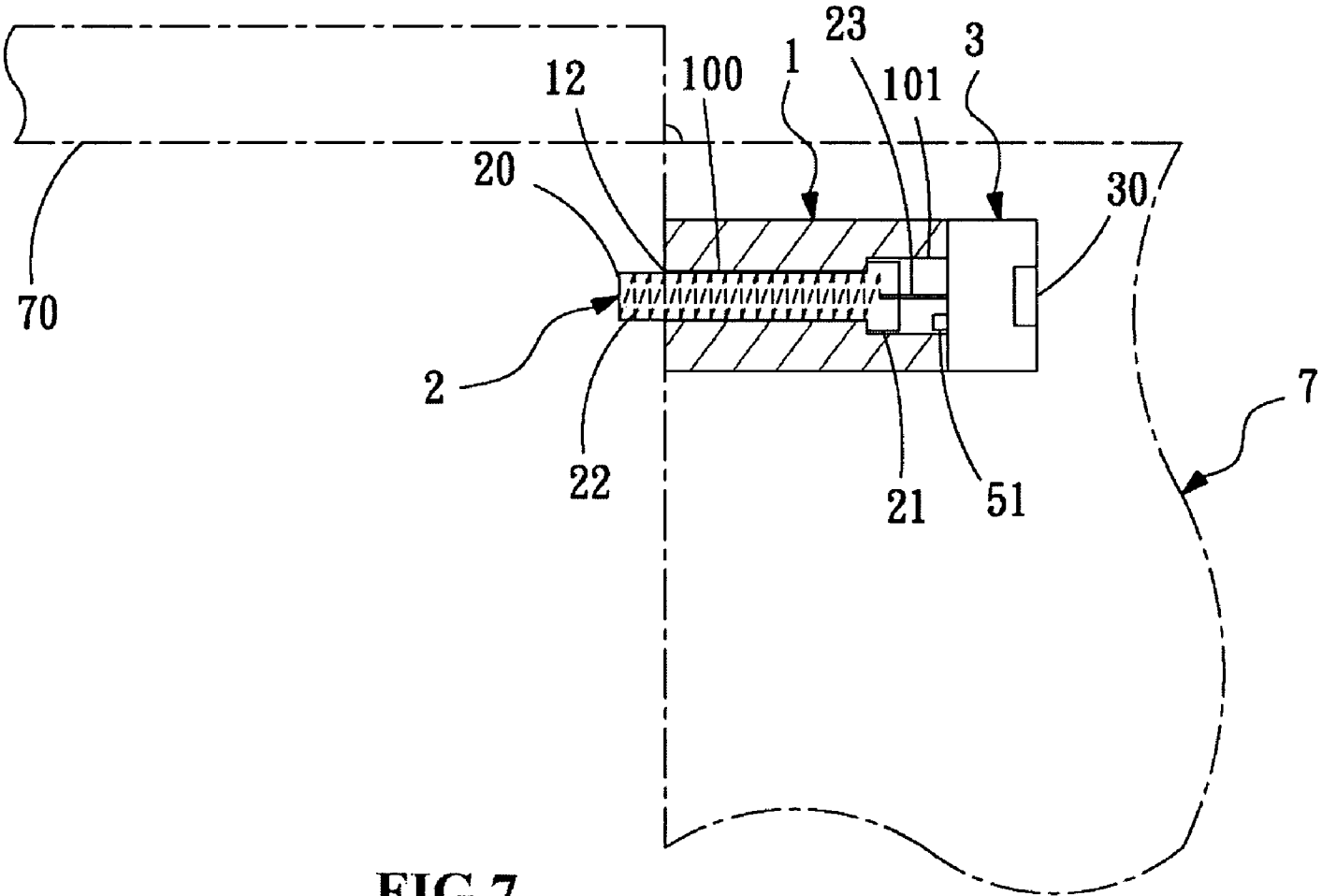
FIG. 7 is a diagram depicting the cabinet door open state of the lamp structure with damper according to the invention.
Figure 8:
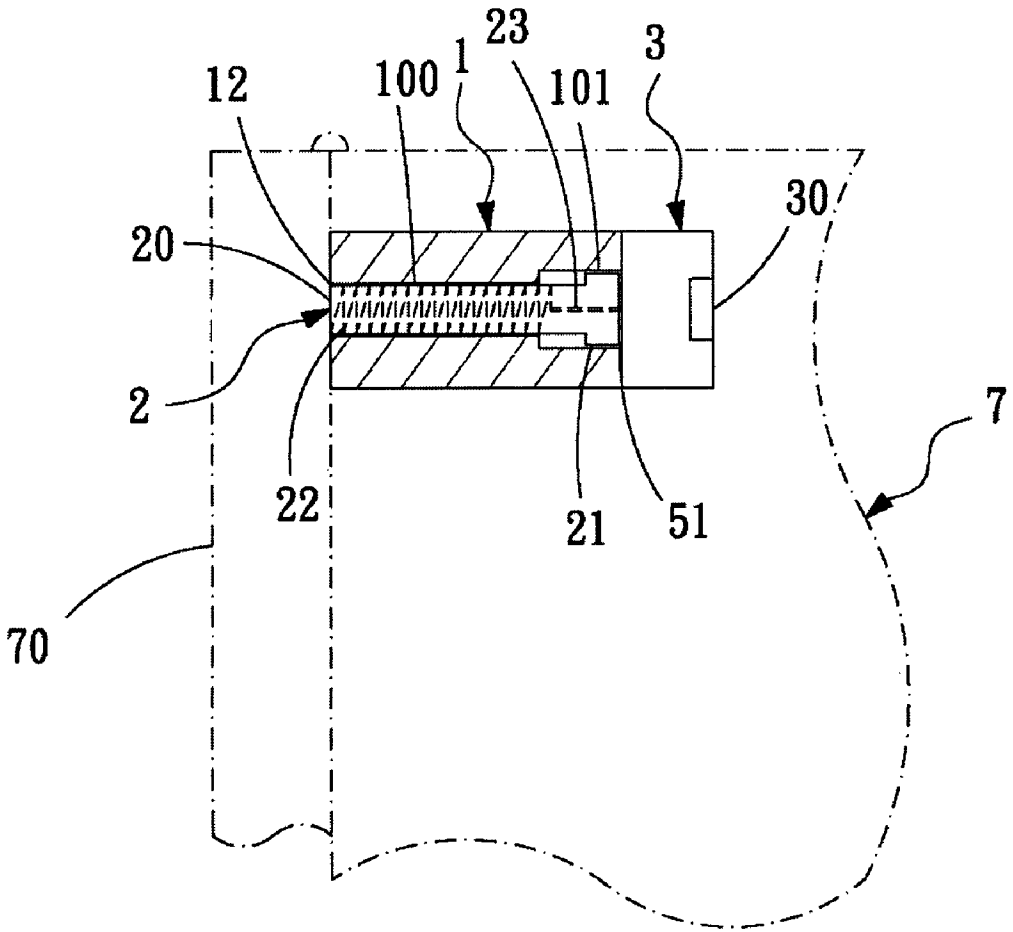
FIG. 8 is a diagram depicting the cabinet door closed state of the lamp structure with damper according to the invention.

Again referring to FIGS. 7~8, FIG. 7 and FIG. 8 are diagrams depicting the cabinet door open and closed states of the lamp structure respectively according to the lamp structure with damper of the invention together with a cabinet. The above-mentioned lamp structure with damper of the invention can be disposed in a cabinet (7). The invention is carried out by the embodiment as below. The fixing plate (6) is mainly disposed firmly inside the cabinet (7) first, and after the fixing plate (6) is fixed on the cabinet (7), the housing (1) is mechanically assembled to be connected to the fixing plate (6). A wing member (60) is extended respectively on two relative lateral sides of the fixing plate (6). Two retaining slots (14) matching with the two wing members (60) are disposed respectively at two relative lateral sides of the housing (1).

Again referring to FIGS. 7~8, the lamp structure with damper of the invention is installed inside the above-mentioned cabinet (7), and the installation methods can be screwing or snapping the fixing plate (6) to the inside of the cabinet (7) (not characteristics of the invention, thus no more detailed description), and then mainly assembling the housing (1) on the fixing plate (6) according to the manner mentioned above. When installed in the cabinet (7), the opening member (12) of the housing (1) faces the exterior environment of the cabinet (7), while the other side of the housing (1) disposed with the illumination member (3) faces the interior of the cabinet (7). When a door plank (70) of the cabinet (7) makes the cabinet (7) in a closed state, the door plank (70) pushes the damper (2) protruding from the opening member (12) so that the damper (2) move towards inside of the housing (1) to the second position, and the first elastic component (22) is also compressed. The second power switch (52) also returns to ON state automatically. The casing of the head member (21) touches the first power switch (51) of the power switch unit (50) to make the power switch unit (50) select the electrical loop member (5) to be in the electrically disconnected state and there is no light generated from the illumination member (3). On the contrary, if the cabinet (7) is opened, the door plank (70) no longer applies a force on the damper (2). The first elastic component (22) releases the recoil force thereof and makes the damper (2) to move out from the housing (1) to the first position. The casing of the head member (21) no longer touches the first power switch (51) of the power switch unit (50) and makes the power switch unit (50) select the electrical loop member (5) to be in the electrically connected state and there is light generated from the illumination member (3) to illuminate the interior of the cabinet (7); certainly, the electrical loop member (5) can be switched to the electrically disconnected state by the second power switch (52) at this moment.

In the lamp structure with damper mentioned above, the first elastic component (22) and the second elastic component (132) are both mechanical components with recoil force such as springs, spring plates, blocks of elastic materials and so on.

As described above, the invention provides a lamp structure with damper that allows the user to light up the interior of a cabinet. The damper protects the cabinet door when being open and closed. The invention possesses inventive step and meets the essential criteria for new utility patent.

The present invention has been disclosed in detail. However the disclosed embodiment should not be construed as a limitation on the actual applicable scope of the invention, and as such, all modifications and alterations without departing from the spirits of the invention and appended claims shall remain within the protected scope and claims of the invention.

What is claimed is:

1. A lamp structure with a damper, comprising:

a housing comprising a casing structure with a hollow member and containing an opening member on one end surface of the housing communicating the hollow member with an exterior environment;

an illumination member comprising an illumination component and the illumination member being arranged on the housing;

a damper comprising a post member, a first elastic component and a shaft, the post member being a hollow post with a casing structure, the cross-sectional area of the post member matching the cross-sectional area of the hollow member, two ends of the post member being a first end member and a second end member respectively, the first end member being one end where the post member passes through the opening member and protrudes out from the housing, the second end member being the other end where the post member moves inside the hollow member, the first elastic component being disposed inside the post member and one end thereof being against a bottom end of the first end member of the post member, the other end of the first elastic component connecting one end of the shaft, the other end of the shaft passing through the casing of the second end member of the post member and touching the housing;

a power supply member being a power source;

an electrical loop member being electrically connected to the illumination member and the power supply member; and a power switch unit disposed in the electrical loop member to switch the status of the electrical loop member;

wherein the damper is movable in the hollow member, a first position being defined when the damper being protruding from the housing and the casing of the damper not touching the power switch unit as well as the electrical loop member being in an electrically connected state; a second position being further defined when the damper returning in the housing and the casing of the damper touching the power switch unit to make the electrical loop member in an electrically disconnected state.

2. The lamp structure with damper according to claim 1, wherein the hollow member further comprises a first hollow member and a second hollow member, the first hollow member communicating the second hollow member, the cross-sectional area of the second hollow member being greater than the cross-sectional area of the first hollow member, the second end member of the post member further comprising a head member, the cross-sectional area of the head member being greater than the cross-sectional area of the post member and the first hollow member, and the post member and the head member being disposed respectively in the first hollow member and the second hollow member.

3. The lamp structure with damper according to claim 2, wherein when the damper moves by the recoil force of the first elastic component, the damper stops at the first position because the cross-sectional area of the head member is greater than the post member and the first hollow member.

4. The lamp structure with damper according to claim 1, wherein the housing further comprises a rotation unit comprising a rotation axle, a fixed axle and a second elastic component, the rotation axle being disposed in the illumination member, the rotation axle matching and touching the fixed axle, the fixed axle being connected to one end of the second elastic component, the other end of the second elastic component being disposed on the housing.

5. The lamp structure with damper according to claim 4, wherein the rotation axle and the fixed axle are both of a gear wheel structure and match with each other.

6. The lamp structure with damper according to claim 4, wherein the first and the second elastic components are springs.

7. The lamp structure with damper according to claim 1, wherein the power supply member is a battery holder or an external power source.

8. The lamp structure with damper according to claim 1, wherein the power switch unit further comprises a first power switch and a second power switch, the damper touching the first power switch, the second power switch independently controlling the electrical loop member to be in the electrically connected or disconnected state, the second power switch being capable of being a key switch.

9. The lamp structure with damper according to claim 8, wherein the second power switch is capable of being controlled by a button on the housing, the button controlling the operation of the key switch.

10. The lamp structure with damper according to claim 9, wherein when the damper is at the second position, that is, the power switch unit is in electrically disconnected state, the second power switch returns automatically to ON state setting.

11. The lamp structure with damper according to claim 10, wherein the power switch unit further comprises a control chip, the control chip being a logic controller and being able to switch the state of the power switch unit to select the electrical loop member to be in the electrically connected or disconnected state in correspondence to the state of the first power switch and the second power switch.

12. The lamp structure with damper according to claim 11, wherein the control chip controls the second power switch to automatically return to ON state setting when the damper is at the second position, that is, when the power switch unit is in electrically disconnected state.

13. The lamp structure with damper according to claim 1, wherein the housing is further mechanically connected to a fixing plate.

14. The lamp structure with damper according to claim 13, wherein a wing member is extended respectively on two relative lateral sides of the fixing plate, two retaining slots matching with the two wing members being disposed at two relatively lateral sides of the housing respectively.

15. The lamp structure with damper according to claim 1, wherein a fluid with damping characteristic is provided in the post member of the damper.

16. The lamp structure with damper according to claim 15, wherein the fluid with damping characteristic is in a liquid or gaseous state.

* * * * *